US010858152B2

(12) United States Patent
Fabozzi et al.

(10) Patent No.: US 10,858,152 B2
(45) Date of Patent: Dec. 8, 2020

(54) METHOD AND DEVICE FOR DISPENSING FROM A SHIPPABLE CONTAINER

(71) Applicant: Plastic Technologies, Inc., Holland, OH (US)

(72) Inventors: Thierry Fabozzi, Holland, OH (US); Daniel Applegate, Holland, OH (US); Aaron Bollinger, Holland, OH (US); Craig Robinson, Holland, OH (US); Sumit Mukherjee, Holland, OH (US)

(73) Assignee: PLASTIC TECHNOLOGIES, INC., Holland, OH (US)

( * ) Notice: Subject to any disclaimer, the term of this patent is extended or adjusted under 35 U.S.C. 154(b) by 0 days.

(21) Appl. No.: 16/383,930

(22) Filed: Apr. 15, 2019

(65) Prior Publication Data

US 2020/0324936 A1 Oct. 15, 2020

(51) Int. Cl.
*B65D 23/08* (2006.01)
*B65D 47/00* (2006.01)

(52) U.S. Cl.
CPC ..... *B65D 23/08* (2013.01); *B65D 47/00* (2013.01)

(58) Field of Classification Search
CPC ..... B05B 11/0038
USPC ..... 222/556, 567, 180, 181.3, 105
See application file for complete search history.

(56) References Cited

U.S. PATENT DOCUMENTS

| | | | | | |
|---|---|---|---|---|---|
| 4,651,902 | A * | 3/1987 | Hobbs | A47K 5/1211 | 222/153.09 |
| 5,474,212 | A * | 12/1995 | Ichikawa | B05B 11/0043 | 222/105 |
| 6,142,344 | A * | 11/2000 | Kai | B65D 75/5883 | 222/105 |
| 6,820,770 | B2 * | 11/2004 | Makino | A47K 5/12 | 222/180 |
| 7,121,431 | B2 * | 10/2006 | Duke | B65D 75/5883 | 222/183 |
| 9,452,857 | B2 * | 9/2016 | Corbett | B65D 77/06 | |
| 9,908,689 | B2 * | 3/2018 | Schulz | B65D 83/0055 | |
| 10,035,621 | B2 * | 7/2018 | Warner | B29C 49/24 | |
| 2011/0036846 | A1 * | 2/2011 | Corbett | B65D 77/06 | 220/495.03 |
| 2011/0220682 | A1 * | 9/2011 | Lim | B05B 11/3023 | 222/183 |
| 2011/0240675 | A1 * | 10/2011 | McDoanald | B05B 15/62 | 222/180 |
| 2012/0111890 | A1 * | 5/2012 | Herring | A47K 5/12 | 222/180 |
| 2014/0252032 | A1 * | 9/2014 | Corbett | B65D 25/18 | 222/105 |

* cited by examiner

*Primary Examiner* — Donnell A Long
(74) *Attorney, Agent, or Firm* — Michael E. Dockins; Shumaker, Loop & Kendrick, LLP

(57) ABSTRACT

A frame for a shippable container is provided, where the shippable container has a hollow body, an opening, and a collar adjacent the opening. The frame has a collar engagement portion configured to engage the collar of the shippable container and a body engagement portion configured to engage a portion of the hollow body of the shippable container. The collar engagement portion and/or the body engagement portion can be configured to engage the collar of the shippable container and prevent rotation of the shippable container about the opening relative to the frame.

20 Claims, 6 Drawing Sheets

METHOD AND DEVICE FOR DISPENSING FROM A SHIPPABLE CONTAINER

FIELD

The present technology relates to shippable containers and frames adapted to shippable containers, including frames that facilitate handling shippable containers and dispensing contents therefrom.

INTRODUCTION

This section provides background information related to the present disclosure which is not necessarily prior art.

Various containers, including various bottles and vessels of various shapes and configurations, can be used for storage and packaging of various contents during transport, shipping, and/or eventual dispensing of the contents therefrom. Contents can include various fluids, including liquids, foams, gels, or other compositions that can flow and that can be managed by various filling and dispensing means. Examples include containers used to store, ship, and dispense various products, including various chemicals, soaps, lotions, and cleaning products, as well as medicines, beverages and foodstuffs, such as water, carbonated drinks, sports drinks, condiments, and sauces, among others. Containers can include a neck or finish portion having an opening that is in communication with an interior hollow body of the container. In some instances, the neck or finish portion can be threaded to permit application of a closure. For example, a structure can be molded into the neck or finish portion to permit a closure to be threaded or snapped on. The neck or finish portion can include at least one sealing surface that is configured to bear against a portion of the closure in order to form a fluid tight seal with respect to the closure when it is properly applied. Containers can also be configured with various integral closure means and/or can be configured to receive various closure means, including various adhesive films, heat seals, threaded caps, snap caps, bottle caps, as well as various tamper evident seals and closures.

A variety of materials have been employed in the design and construction of such containers. For example, containers can be made using various materials including polymeric materials. Such materials are used, at least in part, because they can securely contain liquids or other contents while also providing sufficient structural rigidity and integrity in accommodating various filling, bottling, distributing, shipping, and handling operations. Polymeric containers include various polymeric containers made of polyethylene terephthalate (PET), polypropylene (PP), polyethylene (PE), as well as other suitable materials. Plastic containers can be fabricated using various blow molding and injection molding methods. Blow molding can be characterized by using internal pressure to force a heated plastic preform or parison against a molding surface to form a desired container shape, which can be used for plastic containers that are fabricated from PET, for example. Extrusion blow molding is another process that can be used for containers fabricated from such materials as high-density PE and polyolefins. Blow molded containers can be formed with a integral closure means, such as a threaded finish, at an opening of the container that can be configured to cooperate with a threaded closure, dispenser, and/or cap in order to seal the contents inside the container. The threaded finish can originate from the preform or parison, for example.

In the packaging and shipping industry, lightweight containers can be preferred as they can require less material investment, can be relatively less costly to manufacture and transport, and can minimize waste or recycling logistics. Moving to lightweight containers, however, can result in tradeoffs with respect to structural rigidity and integrity of such containers. Accordingly, there is a need to provide ways to minimize container fabrication and shipping costs while maintaining container durability through various uses thereof, including handling and dispensing of the contents of such containers.

SUMMARY

The present technology includes articles of manufacture, systems, and processes that relate to shippable containers, frames that accommodate such shippable containers, and ways of using frames to store, ship, and dispense various products from shippable containers.

Frames for a shippable container are provided, where the shippable container includes a hollow body, an opening, and a collar adjacent the opening. The frame accommodates the shippable container using a collar engagement portion configured to engage the collar of the shippable container and a body engagement portion configured to engage a portion of the hollow body of the shippable container. The collar engagement portion can be configured to engage the collar and prevent rotation of the shippable container about the opening relative to the frame. The body engagement portion can be configured to engage a portion of the hollow body and prevent rotation of the shippable container about the opening relative to the frame. An opening engagement portion can be provided that is configured to engage the opening of the shippable container and be coupled to the collar engagement portion. The opening engagement portion can include a protrusion that projects into the opening of the shippable container when the opening engagement portion engages the opening of the shippable container. The opening engagement portion can include a valve operable to control passage through the opening of the shippable container when the opening engagement portion engages the opening of the shippable container. A dispenser can be provided that is configured to dispense a fluid from the shippable container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figures 1, 2, 3:
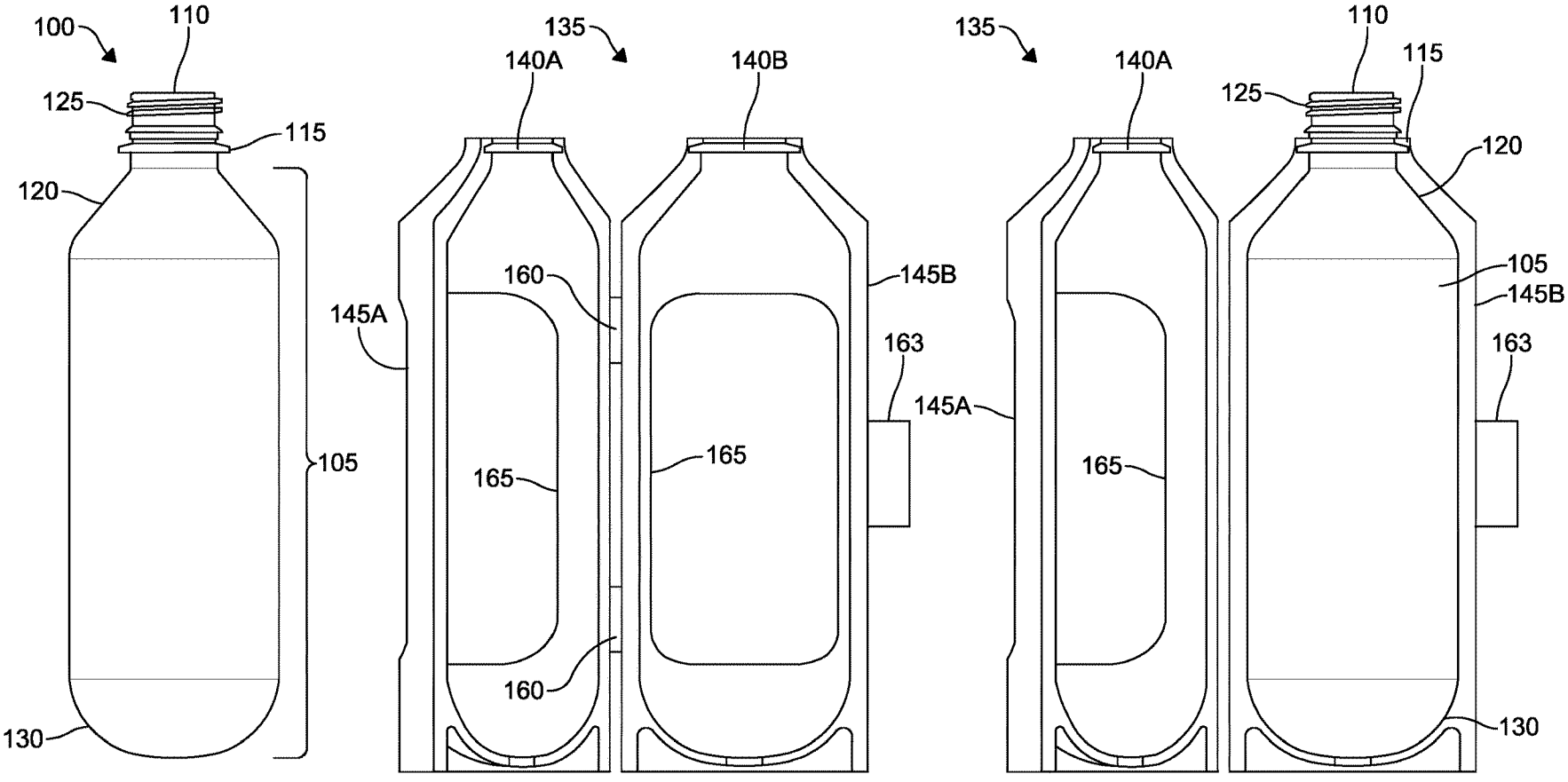
FIG. 1 is a side elevational view of a first embodiment of a shippable container.
FIG. 2 is a side elevational view of a first embodiment of a frame, where the first embodiment of the frame is in an open position ready to receive the first embodiment of the shippable container.
FIG. 3 is a side elevational view of the first embodiment of the frame, where the frame is in an open position and has the shippable container of FIG. 1 placed therein.
Figure 5:
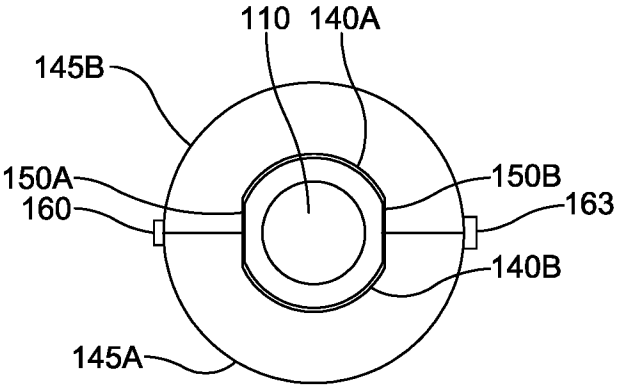
FIG. 5 is a top plan view of the first embodiment of the frame enclosing the first embodiment of the shippable container taken from line 5-5 in FIG. 4.
Figure 4:
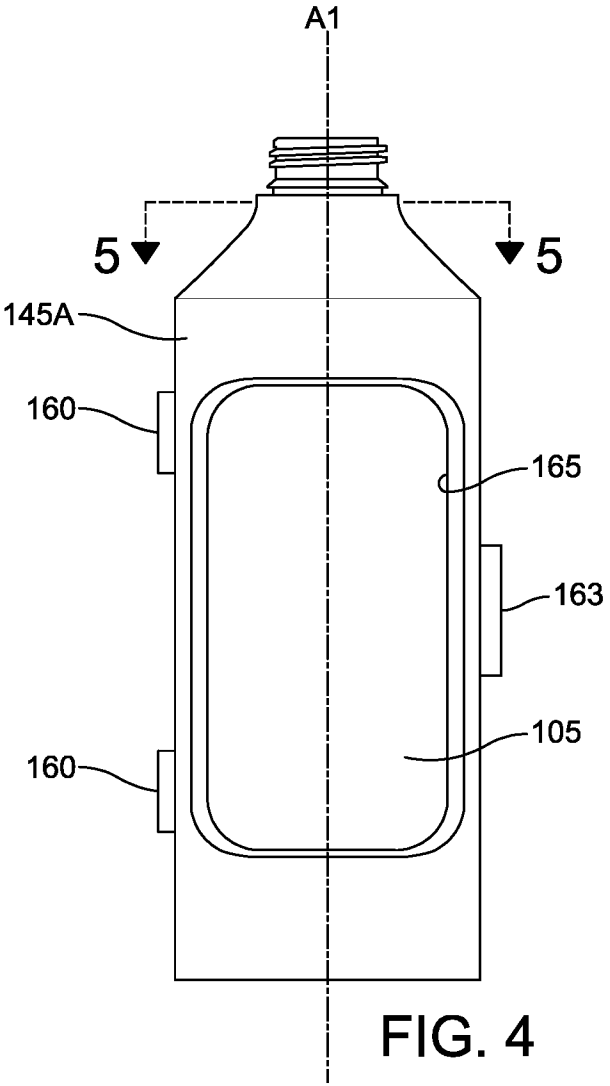
FIG. 4 is a side elevational view of the first embodiment of the frame, where the first embodiment of the frame is in a closed position and has the first embodiment of the shippable container enclosed therein.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology provides articles of manufacture, systems, and ways to use such articles and systems for dispensing contents of shippable containers, where such shippable containers include a hollow body, an opening, and a collar adjacent the opening. In particular, various frames are provided that can be coupled with various portions of shippable containers to optimize container durability during handling and/or dispensing of the contents of such containers. In this way, lightweight containers can be employed that require less material investment, that are less costly to manufacture and transport, and that minimize waste or recycling logistics. The present frames for shippable containers can achieve such special technical effects by using a collar engagement portion configured to engage the collar of the shippable container and a body engagement portion configured to engage a portion of the hollow body of the shippable container as presented herein.

Containers used in the present technology can include the following aspects. The shippable container can include a hollow body, an opening leading to the interior of the hollow body, and a collar adjacent the opening. The container can be formed of a single layer of material or can be formed using multiple layers of the same or different materials, where the entire container or only portions of the container may have multiple layers. Various materials can be used to form the container, including various polymers, glass, pottery, ceramic, and metals such as stainless steel and aluminum. However, containers made from polymer, such as PET, can provide certain manufacturing and cost advantages, including performance advantages with respect to strength and weight in comparison to other materials.

The container can include a base at an end of the container opposite the opening, where the base can define a portion of the hollow body and can be flat, rounded, or tapered in various embodiments. The hollow body can include a shoulder that is defined by a tapering of the hollow body towards the opening. The shoulder can end at a neck that can be of various lengths leading to the collar adjacent the opening. Certain containers can be described as having no neck portion or a minimized neck portion, where the shoulder effectively ends at the collar. It is also possible to have containers without any shoulder or neck, where the opening is sized like a cross-section of the hollow body, the container being jar-like in configuration. The container can also include a finish adjacent the collar and opening, where the finish can range from a smooth surface between the collar and a lip of the opening to where the finish can include various features such as one or more threads to receive a threaded closure and seal the opening. For example, the finish and/or the collar can be formed into a polymeric preform or parison that is subsequently blow-molded into a container. The collar can project about the opening of the container, where the collar can be continuous or discontinuous about the opening. The collar can provide a width (e.g., diameter) relative to the opening and/or the finish that is larger than a portion of the container adjacent the collar on a side of the collar opposite the opening. The hollow body of the container can include a portion having a non-circular cross-section relative to the opening of the container. For example, the hollow body can have one or more flat sides or walls. A shippable container for use with the present technology can include the shippable container described in U.S. patent application Ser. No. 29/669,159 filed on Nov. 6, 2018.

Frames used in the present technology can include the following aspects. As presented herein, the frame includes a collar engagement portion and a body engagement portion. The collar engagement portion is configured to engage the collar of the shippable container and the body engagement portion is configured to engage a portion of the hollow body of the shippable container. The collar engagement portion can be configured to engage the collar and prevent rotation of the shippable container about the opening relative to the frame. For example, the collar can project about the opening of the container, whether continuous or discontinuous, and the collar engagement portion can include a complementary recess configured to receive the projecting collar and prevent rotation of the shippable container about the opening relative to the frame. In certain embodiments, the collar engagement portion can be configured to engage a non-circular collar and prevent rotation of the shippable container about the opening relative to the frame. Where the collar provides a square-like cross-section relative to the opening, for example, the collar engagement portion can include a complementary recess so that the square-like collar cannot spin or rotate within the recess. This is unlike where a perfectly circular collar cross-section relative to the opening could spin or rotate within a complementary circular recess configured within the collar engagement portion relative to the opening.

The body engagement portion of the frame can be configured to engage a portion of the hollow body and prevent rotation of the shippable container about the opening relative to the frame. For example, the body engagement portion can be configured to engage a portion of the hollow body having a non-circular cross-section and prevent rotation of the shippable container about the opening relative to the frame. The body engagement portion can engage a flat or planar side of the hollow body so that the shippable container cannot spin or rotate about the opening relative to the frame. This is in contrast to where if the body engagement portion only contacted or engaged a portion of the hollow body having a circular cross-section relative to the opening, the hollow body could possibly spin or rotate about the opening relative to the frame. The body engagement portion can also be designed to cover, enclose, and/or engage various portions and amounts of the shippable container. For example, the body engagement portion can be configured to engage a portion of the hollow body opposite the opening, such as a bottom of the shippable container, whether flat, curved, tapered, etc. The body engagement portion can also be configured to circumscribe a portion of the hollow body, including where the body engagement portion and/or other portions of the frame circumscribe multiple portions of the hollow body.

The frame can therefore include one or more features that prevent rotation of the shippable container once engaged by the frame. Preventing rotation can preserve a desired orientation of the shippable container with respect to the frame, which can be important for performance and/or aesthetic purposes, including maintenance of seals or sealing functions, engagement and wear issues, preserving orientation of indicia, instructions, or a content-viewing window in the container relative to the frame, among other purposes. Rotation can be prevented about the opening of the container relative to the frame, where rotation can include an extent of turning about an axis of the shippable container, where the axis passes through the opening of the container. For example, the axis can represent a longitudinal axis of the shippable container running through the opening, through the hollow body, and out a side of the hollow body opposite the opening, such as the bottom of the container.

In certain embodiments, the collar engagement portion and the body engagement portion of the frame are comprised by a clamshell structure that is configured to at least partially enclose the shippable container. The clamshell structure can include a hinge and a clasp allowing the frame to be opened and closed in order to receive, remove, and/or exchange a shippable container. In this way, the frame can be reused with multiple shippable containers, such as where the contents of a shippable container enclosed by the clamshell structure are depleted. The clamshell structure can also include one or more apertures configured to expose a portion of the shippable container when the clamshell structure encloses the shippable container. Where the shippable container is at least partially translucent, for example, the aperture can provide a means to view an extent of the contents remaining in the shippable container while still engaged with the frame. The aperture(s) can also permit viewing of various indicia, colors, or other identifying means relative to the shippable container type and/or contents thereof.

The frame for the shippable container can also include an opening engagement portion that is configured to engage the opening of the shippable container. The opening engagement portion can be coupled to the collar engagement portion, for example, where the opening engagement portion is hingedly coupled to the collar engagement portion. The opening engagement portion can engage the opening of the shippable container in various ways, including various snap fitting or stopper-like configurations. In some embodiments, the opening engagement portion can include one or more interlocking members that cooperate with one or more interlocking members of the collar engagement portion and/or the body engagement portion. Such interlocking members can therefore couple the opening engagement portion to the opening and retain the opening engagement portion in an engaged state with the opening of the shippable container. Examples of interlocking members include one or more resilient members, detents, or snap-fittings including cantilever, torsional, and annular snap-fittings.

The opening engagement portion can include the following additional aspects. The opening engagement portion can further include one or more protrusions that project into the opening of the shippable container when the opening engagement portion engages the opening of the shippable container. The protrusion can be used to displace, puncture, tear, or deflect a closure or seal located at the opening of the shippable container when the opening engagement portion engages the opening of the shippable container. For example, the shippable container can have a foil seal on the opening, where the protrusion compromises the seal in some fashion to provide access to the contents of the shippable container when the opening engagement portion engages the opening of the shippable container. The seal can also have one or more perforations or other directed or guided tear-lines thereon that cooperate with the protrusion to facilitate and/or guide opening of the seal. In certain embodiments, the opening engagement portion can include a valve operable to control passage through the opening of the shippable container when the opening engagement portion engages the opening of the shippable container. The valve can be formed of various materials in various configurations, for example, including a silicone valve and where the valve is designed as a check valve. The opening engagement portion can also include a threaded portion on an outer surface thereof. In this way, a dispenser (e.g., pump dispenser, spray trigger dispenser, etc.) can be coupled to the opening engagement portion. The opening engagement portion, moreover, can be hingedly coupled to the collar engagement portion to allow the opening engagement portion to pivot between an open state where the opening engagement portion does not engage the opening of the shippable container and a closed state where the opening engagement portion engages the opening of the shippable container.

The frame and/or the shippable container can be further provided with a dispenser configured to dispense a fluid from the shippable container. In certain embodiments, the dispenser can be coupled to the opening of the shippable container. In other embodiments, the the dispenser can be configured to be coupled to the frame. The dispenser, for example, can be coupled to the opening engagement portion and/or the collar engagement portion of the frame. Various dispensers include pump dispensers, spray dispensers including bulb, trigger, and other pump sprayers and atomizers, which can include a length of tubing that is inserted into the hollow body of the shippable container through the opening, the tubing configured to draw or siphon contents of the container by action of a dispensing mechanism and dispensing nozzle located external to the shippable container. Features that prevent rotation of the shippable container about the opening relative to the frame can improve the attachment of the dispenser, for example, where the opening of the container can remain stationary while a dispenser is threaded thereon.

Systems for framing a shippable container can include one or more shippable containers as described herein and one or more frames as described herein. For example, the shippable container can include a hollow body, an opening, and a collar adjacent the opening and the frame can include a collar engagement portion configured to engage the collar of the shippable container and a body engagement portion configured to engage a portion of the hollow body of the shippable container.

Shippable containers and frames as provided by the present technology can be used in various ways. Methods of using a shippable container can include the following steps. A frame can be provided that includes a collar engagement portion configured to engage the collar of the shippable container and a body engagement portion configured to engage a portion of the hollow body of the shippable container. The collar of the shippable container can be engaged with the collar engagement portion of a frame. A portion of the hollow body can be engaged with the body engagement portion. The collar engagement portion can be configured to engage the collar and prevent rotation of the shippable container about the opening relative to the frame and/or the body engagement portion can be configured to engage a portion of the hollow body and prevent rotation of the shippable container about the opening relative to the frame. Contents can be dispensed from the hollow body of the shippable container using a dispenser coupled to the container directly or through one or more portions of the frame.

EXAMPLES

Example embodiments of the present technology are provided with reference to the several figures enclosed herewith.

With reference to FIGS. 1-5, a first embodiment of a shippable container 100 is shown having a hollow body 105, an opening 110, and a collar 115 adjacent the opening 110. The container 100 has a shoulder 120 tapering toward the collar 115 and a threaded finish 125 between the opening 110 and the collar 115. A base 130 of the container 100 is located at the bottom of the hollow body 105, generally opposite the opening 110 in the embodiment shown. A first embodiment of a frame 135 is shown having a collar engagement portion 140A, 140B configured to engage the collar 115 of the shippable container 100. A body engagement portion 145A, 145B of the frame 135 is configured to engage a portion of the hollow body 105 of the shippable container 100.

As shown, the collar engagement portion 140A, 140B is configured to engage the collar 115 and prevent rotation of the shippable container 100 about the opening 110 relative to the frame 135. For example, with reference to FIG. 4, when the container 100 is enclosed within the frame 135, the collar engagement portion 140A, 140B prevents the container 100 from rotating about axis A1 running through the opening 110 relative to the frame 135. In this way, engagement of the threaded finish 125 of the container 100 (e.g., using a cap, dispenser, or other attachment) is not hindered by rotation of the container 100 within the frame 135. In the embodiment depicted, the collar engagement portion 140A, 140B is configured as a recess that receives the collar 115 projecting about the opening 110 of the container 100. The collar engagement portion 140A, 140B can be configured to engage a non-circular collar and prevent rotation of the shippable container 100 about the opening 110 relative to the frame 135. The collar engagement portion 140A, 140B can be complementary to flat sides 150A, 150B of the collar 115, where the non-circular projecting perimeter of the collar cannot spin or be rotated when engaged by the complementary non-circular recess of the collar engagement portion 140A, 140B.

The frame 135 as shown is configured to engage a portion of the hollow body 105 opposite the opening 110, which includes the base 130 of the container 135 in the embodiment shown. In fact, the body engagement portion of the first embodiment of the frame 135 is configured to circumscribe a portion of the hollow body 105, including the shoulder 120 and base 130 of the hollow body 105, when the container 100 is enclosed by the frame 135. The particular configuration shown can be described as a clamshell structure 155, where the collar engagement portion 140A, 140B and the body engagement portion 145A, 145B are each comprised by two parts that form the clamshell structure 155 and enclose the shippable container 100. The clamshell structure 155 can include one or more hinges 160 and one or more clasps 163. One or more apertures 165 can be provided in the frame 135 that expose a portion of the shippable container 100 when the clamshell structure 155 encloses the shippable container 100.

With reference to FIGS. 5-11, a second embodiment of a shippable container 200 is shown having a hollow body 205, an opening 210, and a collar 215 adjacent the opening 210. The container 200 has a shoulder 220 tapering toward the collar 215 and at least one flat side 225 on the hollow body 205. A base 230 of the container 200 is located at the bottom of the hollow body 205, generally opposite the opening 210 in the embodiment shown. A second embodiment of a frame 235 is shown having a collar engagement portion 240 configured to engage the collar 215 of the shippable container 200. A body engagement portion 245 of the frame 235 is configured to engage a portion of the hollow body 205 of the shippable container 200.

The body engagement portion 245 of the frame 235 is configured to engage a portion of the hollow body 205 and prevent rotation of the shippable container 200 about the opening 210 relative to the frame 235. For example, with reference to FIG. 9, when the container 200 is enclosed within the frame 235, a flat portion 250 of the body engagement portion 245 is complementary to and abuts the flat side 225 of the container 200, preventing the container 200 from rotating about axis A2 running through the opening 210 relative to the frame 235. The flat side 225 on the hollow body 205 of the container 200 results in a non-circular cross-section for that portion of the hollow body 205.

Figure 8:
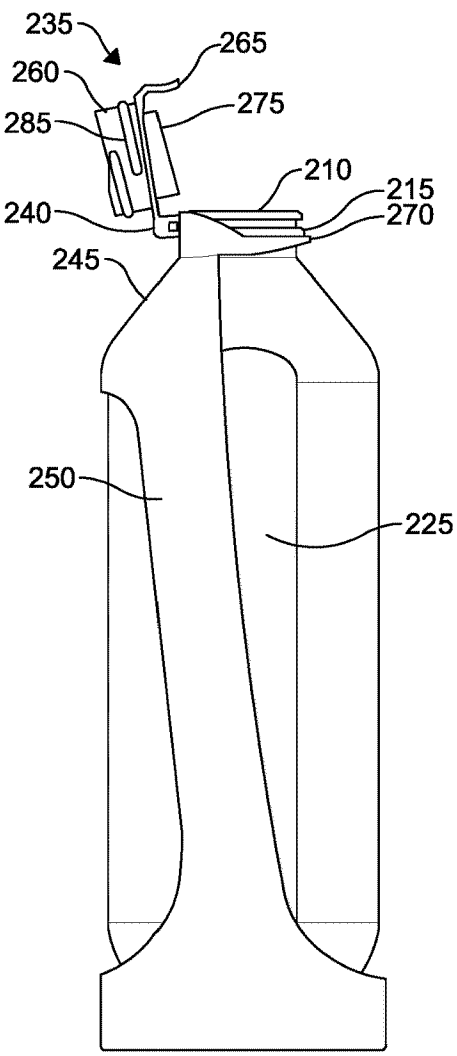
FIG. 8 is a side elevational view of the second embodiment of the shippable container received within the second embodiment of the frame, where an opening engagement portion of the second embodiment of the frame is in an open position.
Figure 7:
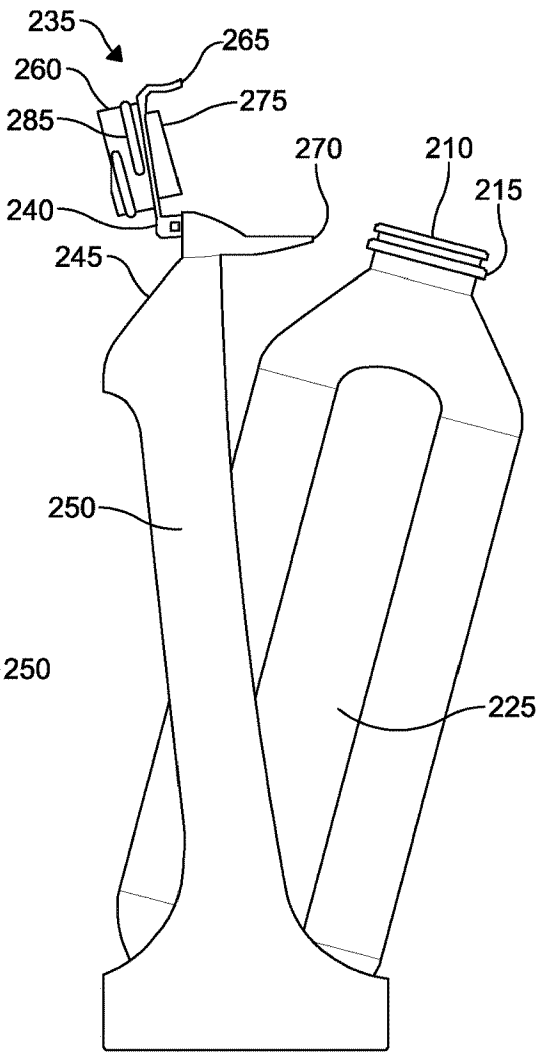
FIG. 7 is a side elevational view of the second embodiment of the frame partially receiving the second embodiment of the shippable container.
Figure 6:
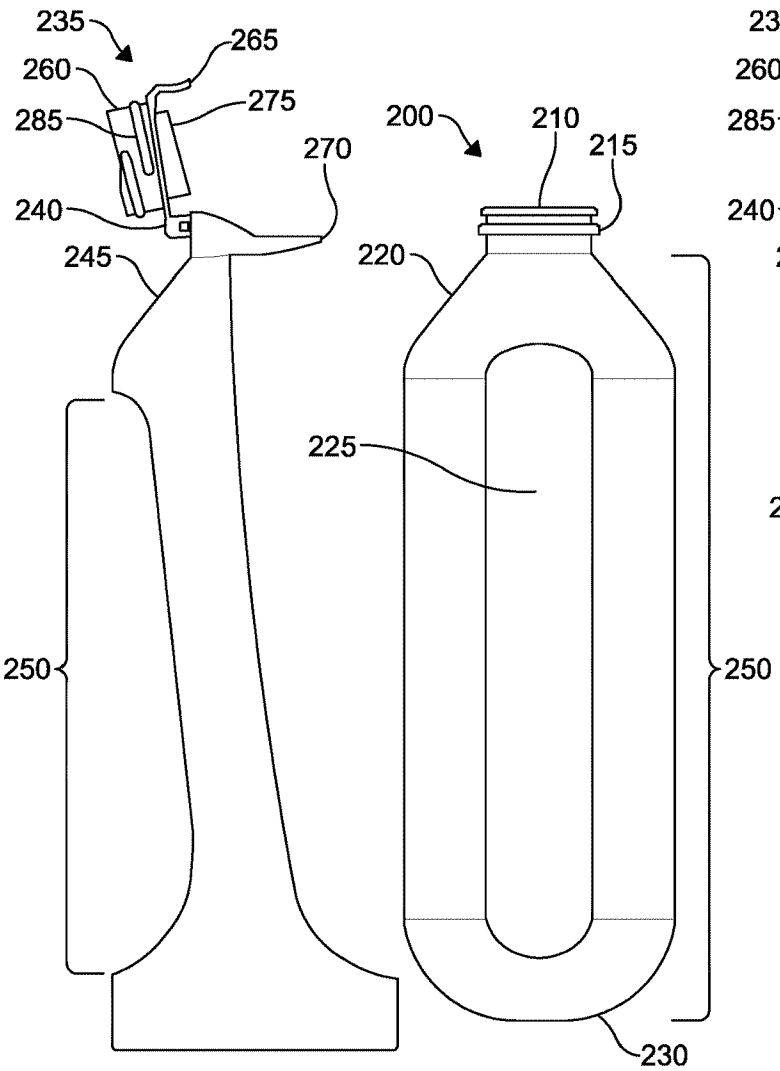
FIG. 6 is a side elevational view of a second embodiment of a frame ready to receive a second embodiment of a shippable container.
Figure 9:
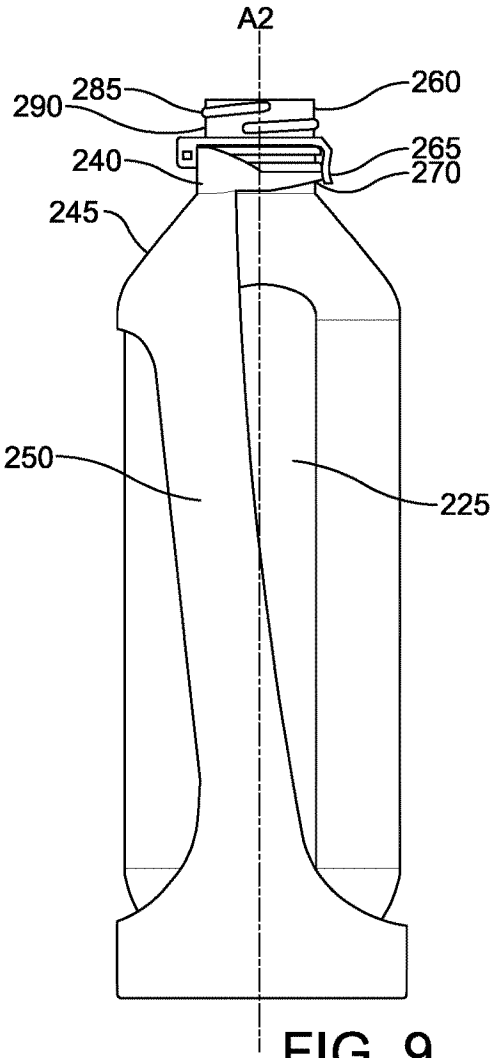
FIG. 9 is a side elevational view of the second embodiment of the shippable container received within the second embodiment of the frame, where the opening engagement portion of the second embodiment of the frame is in a closed position.

The frame 235 includes an opening engagement portion 260 configured to engage the opening 210 of the shippable container 200, where the opening engagement portion 260 is coupled to the collar engagement portion 240. As shown, the opening engagement portion 260 is hingedly coupled to the collar engagement portion 240, but could be coupled in other ways, including through a resilient tab, snap fitting, threaded coupling, etc. FIGS. 6-8 show the opening engagement portion 260 in an open or unengaged position where the opening engagement portion 260 is not engaging the opening 210 of the container 200. FIG. 9 shows the opening engagement portion 260 engaged with the opening 210, where the particular embodiment depicted has the opening engagement portion 260 pivoted relative to its coupling with the collar engagement portion 240 to a closed or engaged position with the opening 210.

Figure 11:
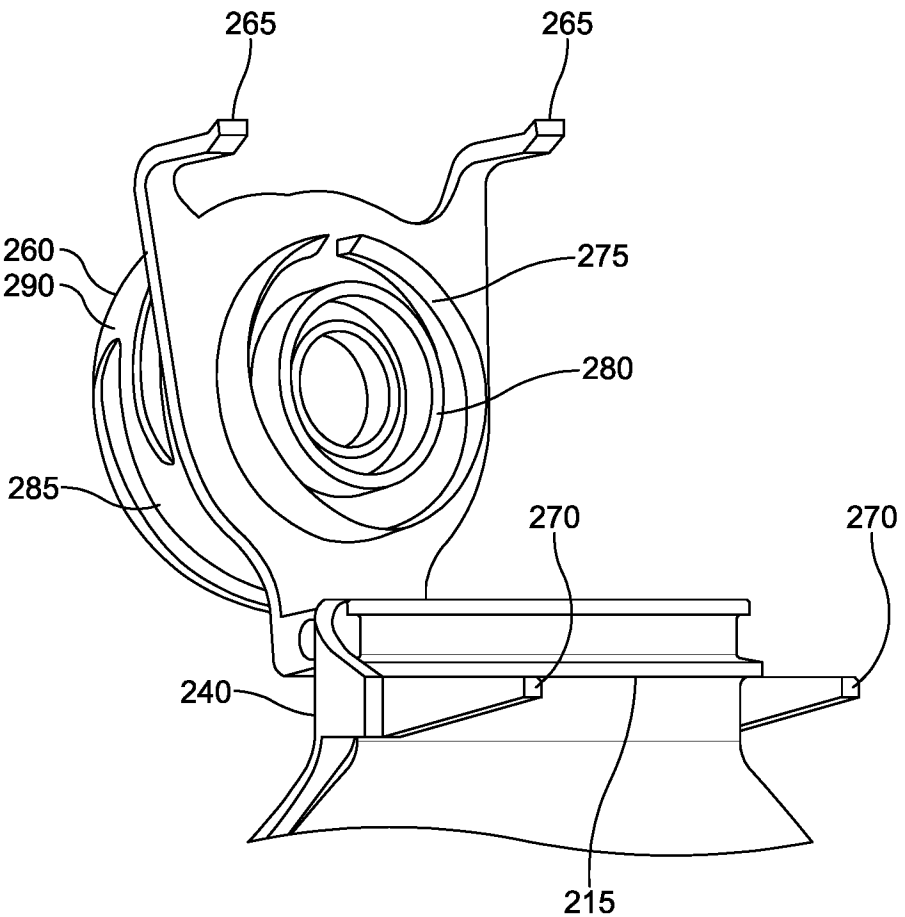
FIG. 11 is a close-up perspective view of the opening engagement portion of the second embodiment of the frame in the open position.

Further details of the opening engagement portion 260 are shown in FIG. 11, where resilient tabs 265 can interface with the collar 215 of the container 200 to facilitate coupling and engaging the opening engagement portion 260 with the opening 210. The tabs 265 and the collar 210, for example, can be configured to provide a snap fitting therebetween. It is also possible for the tabs 260 to interface with the collar engagement portion 240 to facilitate coupling and engaging the opening engagement portion 260 with the opening 210. As shown, two projections 270 of the collar engagement portion 240 can guide and/or abut the tabs 265 of the opening engagement portion 240. The opening engagement portion 240 can therefore be held in the closed or engaged position with respect to the opening 210 of the container by independent or concerted action between the collar 215 and one or more tabs 265 and/or one or more projections 270.

The opening engagement portion 240 can also include a protrusion 275 that is configured to project into the opening 210 of the shippable container 200 when the opening engagement portion 240 engages the opening 210 of the shippable container 200. The protrusion 275 can therefore displace, pierce, and/or perforate a seal (e.g., a foil or plastic seal) or plug located on or within the opening 210 of the container 200. For example, the container 200 can be sealed during shipping, transport, and/or storage, and when the container 200 is then coupled with the frame 235 subsequent to use and dispensing of the contents therefrom, the engagement of the opening engagement portion 240 with the opening 210 results in the protrusion 275 breaking, displacing, piercing, and/or perforating the seal or plug within the opening 210. The seal (e.g., the foil or plastic seal) located on or within the opening 210 can also have one or more perforations or other directed or guided tear-lines thereon that cooperate with the protrusion 275 to facilitate and/or guide opening of the seal. The opening engagement portion 240 can also include a valve 280 operable to control passage through the opening of the shippable container 200 when the opening engagement portion 240 engages the opening 210 of the shippable container 200. The valve 280 can operate to control dispensing of contents of the container 200 once the seal or plug is no longer effective by action of the protrusion 275. Engagement of the opening engagement portion 240 with the opening 210 can provide a fluid-tight seal therebetween.

The valve 280 can also be configured to be coupled with a dispensing means, including a feed line of a spraying mechanism that is inserted into the container 200. The opening engagement portion 240 can also have further coupling means shown as a threaded portion 285 on an outer surface 290 thereof. The threaded portion 285 can cooperate with a complementary threaded portion on a dispensing means, for example, allowing a pump or spray mechanism to be attached to the frame 235.

Figure 12:
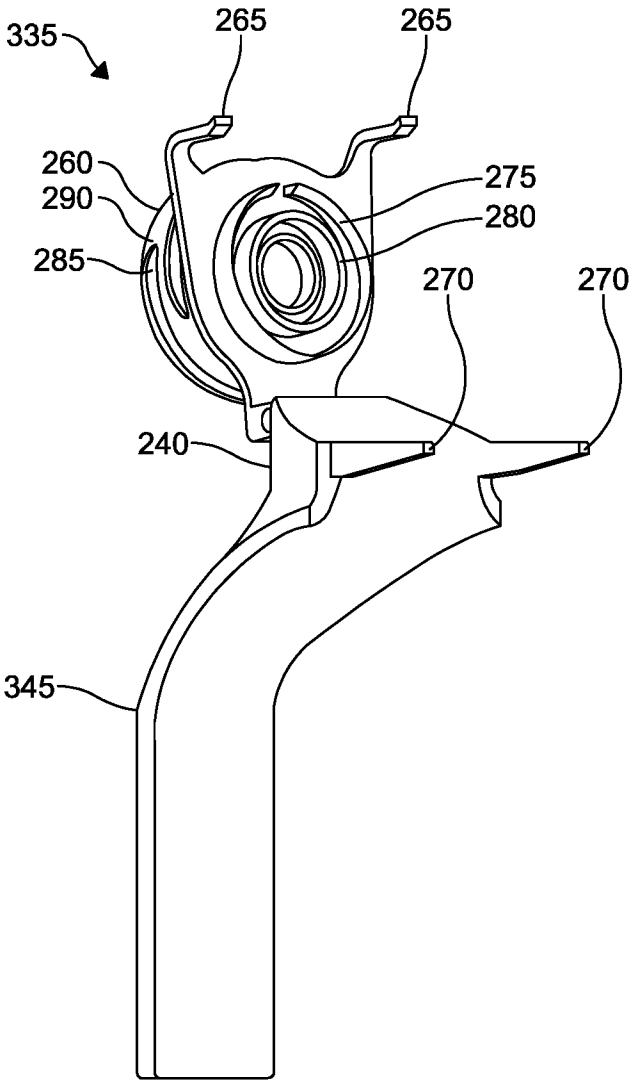
FIG. 12 is a perspective view of a third embodiment of a frame having an opening engagement portion in an open position.

With reference to FIG. 12, a third embodiment of a frame 335 is shown having a collar engagement portion 340 and a body engagement portion 345, where the frame 335 can be used with the shippable container 100 as shown in FIGS. 1-5 or the shippable container 200 as shown in FIGS. 6-10. The collar engagement portion 340 is configured to engage the collar 115, 215 of the shippable container 100, 200. The body engagement portion 345 is configured to engage a portion of the hollow body 105, 205 of the shippable container 100, 200. The frame 335 further includes an opening engagement portion 260, as per the second embodiment shown in FIGS. 6-11, where the opening engagement portion 260 is configured to engage the opening 110, 210 of the shippable container 100, 200, and where the opening engagement portion 260 is coupled to the collar engagement portion 340. The body engagement portion 345 can include or be configured to operate with a mounting or fastening means, allowing the frame 335 to be attached to a wall or other surface, for example.

Figure 10:
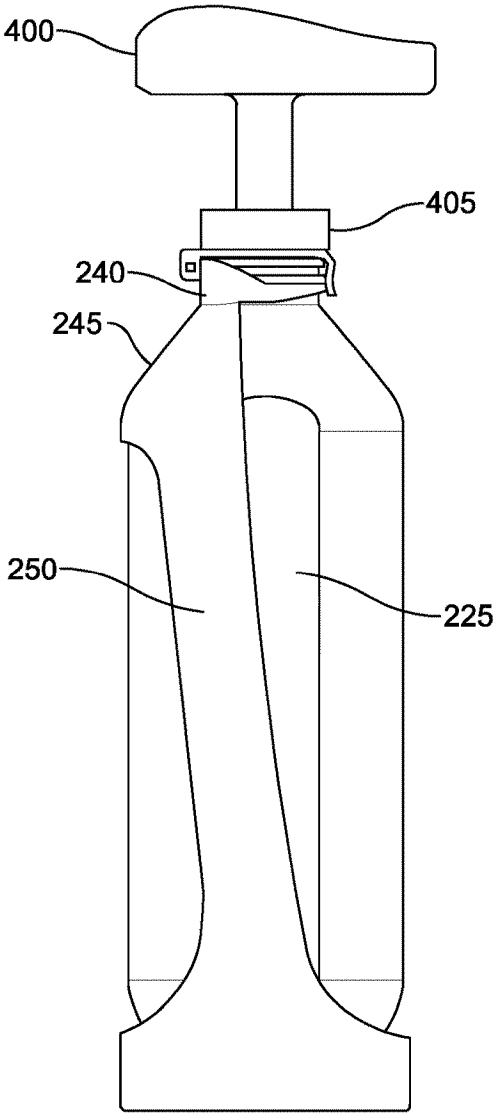
FIG. 10 is a side elevational view of the second embodiment of the shippable container received within the second embodiment of the frame, where the opening engagement portion of the second embodiment of the frame is in the closed position, and a dispenser is coupled to the opening engagement portion.
Figure 14:
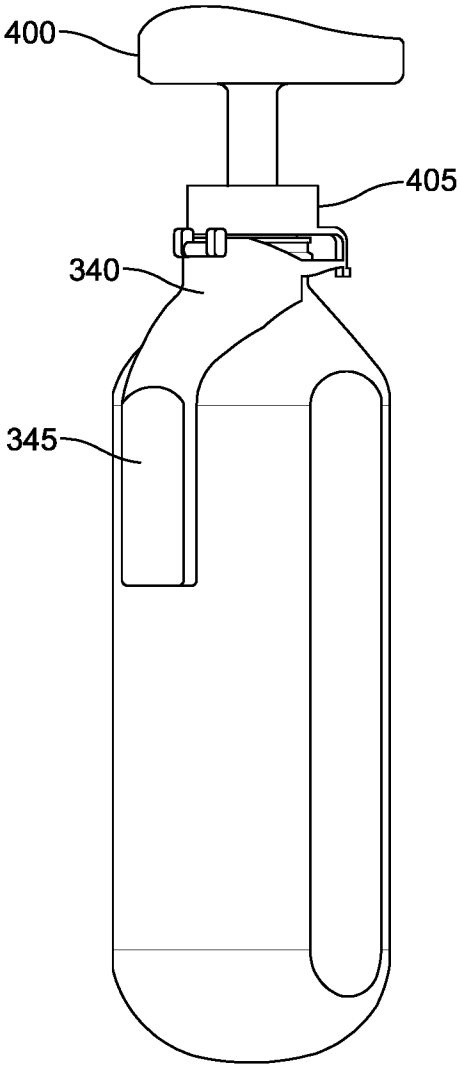
FIG. 14 is a side elevational view of the third embodiment of the frame engaging the second embodiment of the shippable container, where a dispenser is coupled to the opening engagement portion.
Figure 13:
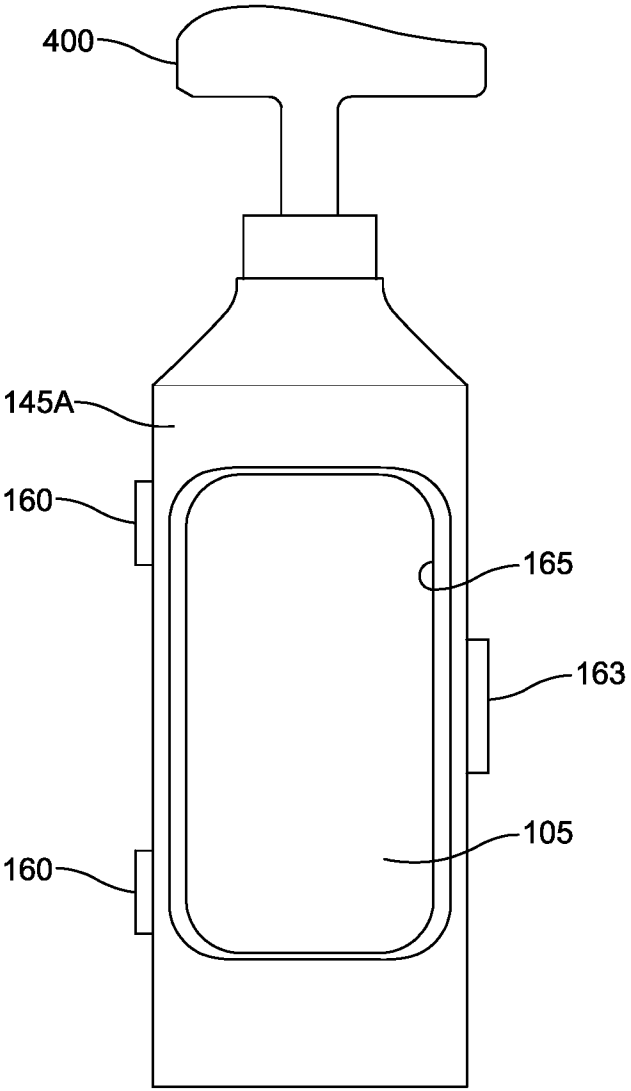
FIG. 13 is a side elevational view of the first embodiment of the frame enclosing the first embodiment of the shippable container, where a dispenser is coupled to the shippable container.

The various frames 135, 235, 335 and/or containers 100, 200 coupled thereto can be outfitted with various dispensing means, such as pump dispensers, spray trigger dispensers, etc., for dispensing the contents of the container 100, 200. As shown in FIG. 10, the second embodiment of the shippable container 200 is received within the second embodiment of the frame 235, where the opening engagement portion 260 of the second embodiment of the frame 235 is in the closed position, and a dispenser 400 is coupled to the opening engagement portion 260 via the threaded portion 285 on the outer surface 290 thereof. As shown in FIG. 13, the first embodiment of the frame 135 encloses the first embodiment of the shippable container 100, where a dispenser 400 is coupled to the shippable container 100 via the threaded finish 125. As shown in FIG. 14, the third embodiment of the frame 335 is engaged with the second embodiment of the shippable container 200, where the opening engagement portion 260 of the third embodiment of the frame 335 is in the closed position, and a dispenser 400 is coupled to the opening engagement portion 260 via the threaded portion 285 on the outer surface 290 thereof.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A frame for a shippable container, the shippable container including a hollow body, an opening, and a collar adjacent the opening, the frame comprising:
   - a collar engagement portion configured to engage the collar of the shippable container; and
   - a body engagement portion configured to engage a portion of the hollow body of the shippable container, wherein the body engagement portion is configured to engage a portion of the hollow body and prevent rotation of the shippable container about the opening relative to the frame, wherein the rotation is prevented with respect to a longitudinal axis of the shippable container passing through the opening and the hollow body.

2. The frame of claim 1, wherein the collar engagement portion is configured to engage the collar and prevent rotation of the shippable container about the opening relative to the frame.

3. The frame of claim 2, wherein the collar engagement portion is configured to engage a non-circular collar and prevent rotation of the shippable container about the opening relative to the frame.

4. The frame of claim 1, wherein the body engagement portion is configured to engage a portion of the hollow body having a non-circular cross-section and prevent rotation of the shippable container about the opening relative to the frame.

5. The frame of claim 1, wherein the body engagement portion is configured to engage a portion of the hollow body opposite the opening.

6. The frame of claim 1, wherein the body engagement portion is configured to circumscribe a portion of the hollow body.

7. The frame of claim 1, wherein the collar engagement portion and the body engagement portion are comprised by a clamshell structure that is configured to enclose the shippable container.

8. The frame of claim 7, wherein the clamshell structure includes a hinge and a clasp.

9. The frame of claim 7, wherein the clamshell structure includes an aperture configured to expose a portion of the shippable container when the clamshell structure encloses the shippable container.

10. The frame of claim 1, further comprising an opening engagement portion configured to engage the opening of the shippable container and be coupled to the collar engagement portion.

11. The frame of claim 10, wherein the opening engagement portion includes a protrusion that projects into the opening of the shippable container when the opening engagement portion engages the opening of the shippable container.

12. The frame of claim 10, wherein the opening engagement portion includes a valve operable to control passage through the opening of the shippable container when the opening engagement portion engages the opening of the shippable container.

13. The frame of claim 10, wherein the opening engagement portion includes a threaded portion on an outer surface thereof.

14. The frame of claim 10, wherein the opening engagement portion is hingedly coupled to the collar engagement portion to allow the opening engagement portion to pivot between an open state where the opening engagement portion does not engage the opening of the shippable container and a closed state where the opening engagement portion engages the opening of the shippable container.

15. The frame of claim 1, further comprising a dispenser configured to dispense a fluid from the shippable container.

16. The frame of claim 15, wherein the dispenser is configured to be coupled to the frame.

17. A method of using a shippable container, the shippable container including a hollow body, an opening, and a collar adjacent the opening, the method comprising:

providing a frame including:

a collar engagement portion configured to engage the collar of the shippable container, and a body engagement portion configured to engage a portion of the hollow body of the shippable container, wherein the body engagement portion is configured to engage a portion of the hollow body and prevent rotation of the shippable container about the opening relative to the frame, wherein the rotation is prevented with respect to a longitudinal axis of the shippable container passing through the opening and the hollow body;

engaging the collar with the collar engagement portion; and engaging the portion of the hollow body with the body engagement portion.

18. The method of claim 17, wherein:

the collar engagement portion is configured to engage the collar and prevent rotation of the shippable container about the opening; or the body engagement portion is configured to engage a portion of the hollow body and prevent rotation of the shippable container about the opening.

19. The method of claim 17, further comprising dispensing contents from the hollow body of the shippable container.

20. A system for framing a shippable container comprising:

a shippable container including a hollow body, an opening, and a collar adjacent the opening; and a frame including a collar engagement portion configured to engage the collar of the shippable container and a body engagement portion configured to engage a portion of the hollow body of the shippable container, wherein the body engagement portion is configured to engage a portion of the hollow body and prevent rotation of the shippable container about the opening relative to the frame, wherein the rotation is prevented with respect to a longitudinal axis of the shippable container passing through the opening and the hollow body.

* * * * *